United States Patent [19]

Allen

[11] Patent Number: 4,678,405

[45] Date of Patent: Jul. 7, 1987

[54] LOW NET POSITIVE SUCTION HEAD PUMPS

[75] Inventor: Harvey G. Allen, Murrysville, Pa.

[73] Assignee: Westinghouse Electric Corp., Pittsburgh, Pa.

[21] Appl. No.: 580,040

[22] Filed: Feb. 14, 1984

[51] Int. Cl.[4] ..... F04D 1/08

[52] U.S. Cl. ..... 417/245; 417/247; 415/110; 415/62

[58] Field of Search ..... 417/244–247; 415/60, 62, 68, 122 R, 104

[56] References Cited

U.S. PATENT DOCUMENTS

| | | | |
|---|---|---|---|
| 992,005 | 5/1911 | Krogh | 415/104 |
| 1,089,248 | 3/1914 | Michell | 417/245 |
| 2,349,731 | 5/1944 | Hornschuch | 417/244 |
| 2,839,005 | 6/1958 | Means | 417/247 |
| 3,004,494 | 10/1961 | Corbett | 417/245 |
| 3,581,504 | 6/1971 | Andrus | 417/244 X |
| 3,639,074 | 2/1972 | Killick | 415/110 |
| 3,981,628 | 9/1976 | Carter | 417/247 |
| 4,396,302 | 8/1983 | Drevet et al. | 415/110 X |

FOREIGN PATENT DOCUMENTS

| | | | |
|---|---|---|---|
| 264422 | 1/1927 | United Kingdom | 417/244 |
| 775547 | 5/1957 | United Kingdom | 417/244 |

*Primary Examiner*—Carlton R. Croyle
*Assistant Examiner*—Theodore W. Olds
*Attorney, Agent, or Firm*—L. A. DePaul

[57] ABSTRACT

A pump is disclosed for pumping a volatile fluid having a given vapor pressure. The pump of this invention comprises a pump housing comprising an inlet for introducing the liquid at a relatively low static pressure level into the pump housing and an outlet for discharging the liquid from the pump housing at a relatively high static pressure level. A fluid path extends from the inlet to the outlet. A booster stage impeller is rotatively mounted for drawing the fluid through the inlet and for pumping the fluid along the fluid path with an increased kinetic pressure. A diffuser is affixedly disposed within the pump housing to intercept the fluid directed along the fluid path by the booster stage impeller for converting the kinetic pressure imparted to the fluid into increased static pressure. A main stage impeller is rotatively driven by a pump motor at a relatively high speed to impart a relatively high static pressure to the fluid being introduced thereto and for discharging the fluid at a relatively high static pressure. A hydraulic coupler is disposed remotely from the fluid path for hydraulically coupling the main stage impeller and the booster stage impeller to rotate the booster stage impeller at a relatively low speed selected to maintain the low net positive suction pressure applied to the fluid at the inlet greater than the vapor pressure and to ensure that the low net positive suction head, as established by the main stage impeller upon the fluid introduced thereto, exceeds the vapor pressure.

8 Claims, 4 Drawing Figures

LOW NET POSITIVE SUCTION HEAD PUMPS

BACKGROUND OF THE INVENTION

This invention relates to the pumping of volatile liquids and more particularly to pumps operating at low net positive suction head (NPSH) while delivering at its output a relatively large quantity of liquid at a relatively high pressure.

The prior art has recognized significant difficulties in pumping liquids where the liquid pressure (suction pressure) at the pump inlet is very low. The difficulties that arise with low inlet pressure pumps are associated with cavitation or boiling of the liquid being pumped. If the ambient pressure applied to the liquid is below its vapor pressure, the liquid being pumped will boil or cavitate. Cavitation is particularly troublesome at the inlet to the vanes of a centrifugal impeller. At this point in a centrifugal pump, there is an initial depressurization zone through which the fluid must traverse before the impeller vanes become effective in the process of raising the static pressure of the liquid being pumped. Boiling or cavitation will occur in this depressurization zone of the pump if the liquid pressure drops below the vapor pressure of the liquid being pumped. Such cavitation has two undesirable effects. First, a cavitating liquid has an increased chemical activity with the materials of which the pump is made. Rapid oxidation with the pump materials may occur. Secondly, cavitation may create relatively high pressures on various portions of the pump structure with the possible damage to the mechanical structure thereof.

The pressure reduction at the impeller vane inlet becomes acutely greater with increased flow rate and rotational speed of the pump, leading to critical cavitation problems for a number of pumping applications. Liquid sodium pumps for nuclear reactor coolant service is just one example of this. Because of the explosive nature of sodium when exposed to the atmosphere, safety precautions require that penetrations into the liquid metal system (i.e., where a pump shaft penetrates the liquid metal system) occur at a very low pressure point in the system. This is because a mechanical shaft seal, to prevent liquid sodium leakage into the atmosphere, is feasible for a maximum sodium pressure that is only slightly greater than atmospheric pressure. Therefore, the liquid sodium pump must operate at a very low pressure. Also, these pumps are required to handle large volume rates of sodium. These two system design conditions force the liquid sodium pump to operate at or close to a critical cavitating mode.

Thus, it is desired to provide a pump capable of operating at very low NPSH conditions. A reduction in NPSH can be achieved by lowering the rotational speed of the pump's impeller. The following equation relates NPSH to the flow rate of the pump and the rotational velocity of the pump's impeller:

$$NPSH = \left(\frac{N\sqrt{Q}}{S}\right)^{4/3}$$

where,

NPSH = required net positive suct. head in feet

N = pump speed in rpm

Q = pump flow in gpm $S$ = suction specific speed

= 8000 as a conservative value, or 11000 as a maximum practical upper limit

Reducing the impeller speed to satisfy a low NPSH requirement requires further modification of the pump design to meet typical pump head and flow design criteria. For example, to maintain an output pressure at a desired high level, it may be necessary to increase the dimensions of the pump's impeller and housing.

Alternatively, the pump inlet pressure and NPSH can be raised by returning a portion of the pump discharge to the pump inlet. However, such a pump modification reduces the overall efficiency of the pump. As a result, such a modification is not a practical solution to obtain low NPSH while providing a high pressure output.

The prior art has further suggested that two pumping units be coupled in series. The first, or booster pump, operates at a relatively low impeller speed to raise the fluid pressure head to a sufficient level that the second, or main pump, can operate at a relatively high impeller speed considering impeller size, overall pump efficiency, and the desired relatively high pressure output. However, the use of a separate booster pump and a main pump increases the space required and the resultant cost of such a configuration.

In a FINAL REPORT entitled "INDUCER DYNAMICS FULL-FLOW, FULL-ADMISSION HYDRAULIC TURBINE DRIVE, dated Aug. 24, 1969 by Farquhar et al. (NASA CR-72566; AGC-9400-18), there is disclosed a pump or inducer designed to pump a highly volatile liquid such as liquid rocket fuel. The described pump includes an inlet for receiving the volatile liquid. A first stage comprises a low speed inducer that is driven by a hydraulic turbine, as will be explained. A high speed rotor is disposed next within the flow path and is driven by a suitable motor at a relatively high speed. The high speed rotor increases the pressure of the volatile liquid and directs the liquid to drive a plurality of fins of the hydraulic turbine placed directly in the flow path. The fins are in turn connected by a coupling disposed outside of the flow path directly to the low speed inducer, whereby upon rotation of the turbine fins, the low speed inducer will rotate therewith. The speed of the turbine fins and, thus, the low speed inducer is dependent upon the angle with which the fins are mounted with respect to the liquid flow path. The liquid leaving the hydraulic turbine is directed to a main impeller, likewise coupled to the drive motor, before being discharged through an outlet. The problems with such a two-stage pump reside primarily with the use of turbine fins disposed within the primary flow path. First, because of the extra hydraulic losses associated with the inducer, this device should be designed for the minimum power consistent with producing no more than the minimum head required to prevent cavitation at the inlet to the high speed rotor. However, the turbine fins, disposed within the fluid path, significantly reduce the fluid pressure at the outlet of this pump. To compensate for this pressure drop, the high speed rotor must be driven at a relatively higher speed, thus, requiring a higher head inducer stage, with increased pumping losses, to prevent cavitation with the higher speed rotor. Secondly, the turbine fins, disposed in the primary fluid path, are effected by the vagaries of the primary fluid system. For instance, fluid power to the turbine fins can be effected by a change in the pump flow as a result of a change-over in system operating mode. This could cause a significant change in turbine speed with a resulting reduced inducer head and cavitation at the inlet to the high speed rotor. Also, the turbine fins would be subjected to unequal circumferential forces that can occur in the primary fluid flow path within the pump. This could result in severe loads being transmitted to the turbine bearing support system. Finally, the set of turbine fins disposed in the primary fluid path is an additional rotating component that must be considered in the design of the primary fluid path within the pump. As a likely result, the design of the primary flow system within the pump may be detrimentally compromised to accommodate the turbine. Conversely, the design of the turbine is dependent upon the fluid flow conditions that are imposed by the primary system. A likely result of this is a turbine with performance that has been detrimentally compromised because it is required to make use of non-optimum fluid flow conditions that are imposed on it by the primary fluid system in the pump.

Therefore, what is needed is a pump employing a booster or low speed stage and a high speed stage that does not employ driving means disposed within the flow path for driving the low speed or booster stage and additionally ensures that the suction pressure at the input for the second or high speed stage is sufficiently high to avoid cavitation.

SUMMARY OF THE INVENTION

In accordance with these and other objects of this invention, there is described apparatus for pumping a volatile fluid having a given vapor pressure. The pumping apparatus of this invention comprises a pump housing comprising an inlet for introducing the liquid at a relatively low static pressure level into the pump housing and an outlet for discharging the liquid from the pump housing at a relatively high static pressure level. A fluid path extends from the inlet to the outlet. A booster stage impeller is rotatively mounted for drawing the fluid through the inlet and for pumping the fluid along the fluid path with an increased kinetic pressure. A diffuser is affixedly disposed with the pump housing to intercept the fluid directed along the fluid path by the booster stage impeller for converting the kinetic pressure imparted to the fluid into increased static pressure. A main stage impeller is rotatively driven by a pump motor at a relatively high speed to impart a relatively high static pressure to the fluid being introduced thereto and for discharging the fluid at a relatively high static pressure. A hydraulic coupler is disposed remotely from the fluid path for hydraulically coupling the main stage impeller and the booster stage impeller to rotate the booster stage impeller at a relatively low speed selected to maintain the net positive suction pressure applied to the fluid at the inlet greater than the vapor pressure and to ensure that the net positive suction head, as established by the main stage impeller upon the fluid introduced thereto, exceeds the vapor pressure.

BRIEF DESCRIPTION OF THE DRAWINGS

While the specification concludes with claims particularly pointing out and distinctly claiming the subject matter of the invention, it is believed that the invention will be better understood from the following description taken in conjunction with the accompanying drawings, wherein:

DESCRIPTION OF THE PREFERRED EMBODIMENT

Figure 1:
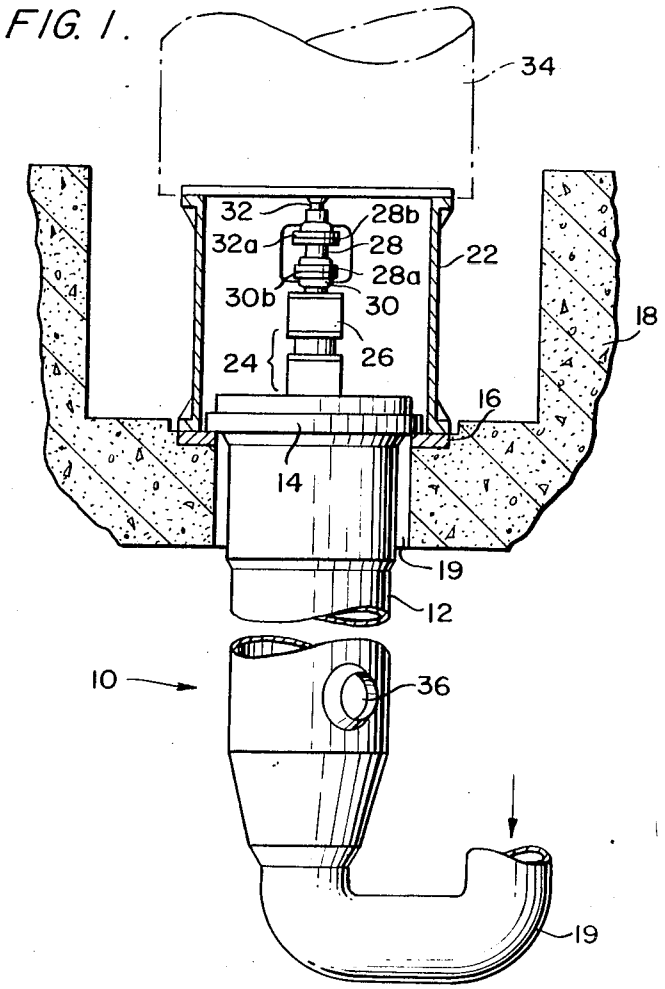
FIG. 1 is a side, partially sectioned view of a low NPSH pump in accordance with this invention, particularly illustrating the manner in which this pump may be mounted with regard to a reservoir of a volatile liquid to be pumped.

Referring now to the drawings and, in particular to FIG. 1, there is shown a low net positive suction head (NPSH) pump 10 in accordance with the teachings of this invention. The low NPSH pump 10 includes an outer housing in the form of a tank 12 and a mounting flange 14. The mounting flange 14 assists mounting within a housing shield 18 that serves to contain a reactor primary piping system for a liquid metal, e.g., sodium. It is contemplated that the pump 10 may be used to pump liquid sodium within a nuclear reactor, noting that the sodium may be radioactive requiring the housing shield 18 of dense construction such as would be provided by a concrete material. In turn, the inlet and outlet conduits 19 and 20 connect the low NPSH pump 10 in circuit with the primary piping system. The primary piping system includes the low NPSH pump 10, the nuclear reactor, a heat exchanger and the connecting piping; all of the primary piping system is located below the housing shield 18. The internal assembly of the low NPSH pump 10 is attached to another mounting flange 17 mounted on top of the tank flange 14. The internal assembly can be withdrawn from the pump tank 12 through the opening of the tank flange 14. In particular, the mounting ring 16 sets in an annular recess of the concrete housing shield 18. The mounting flange 14 is disposed on top of mounting ring 16 and is used for suspending the tank 12. In turn, the cylinder flange 17 sets on top of the mounting flange 14 and supports the internal assembly of the low NPSH pump 10. An opening 19 within the housing shield 18 receives the low NPSH pump 10 therein. In particular, a mounting ring 16 is disposed about the opening 19 for receiving the mounting flange 14, whereby the low NPSH pump 10 is mounted on the housing shield 18.

Figure 2:
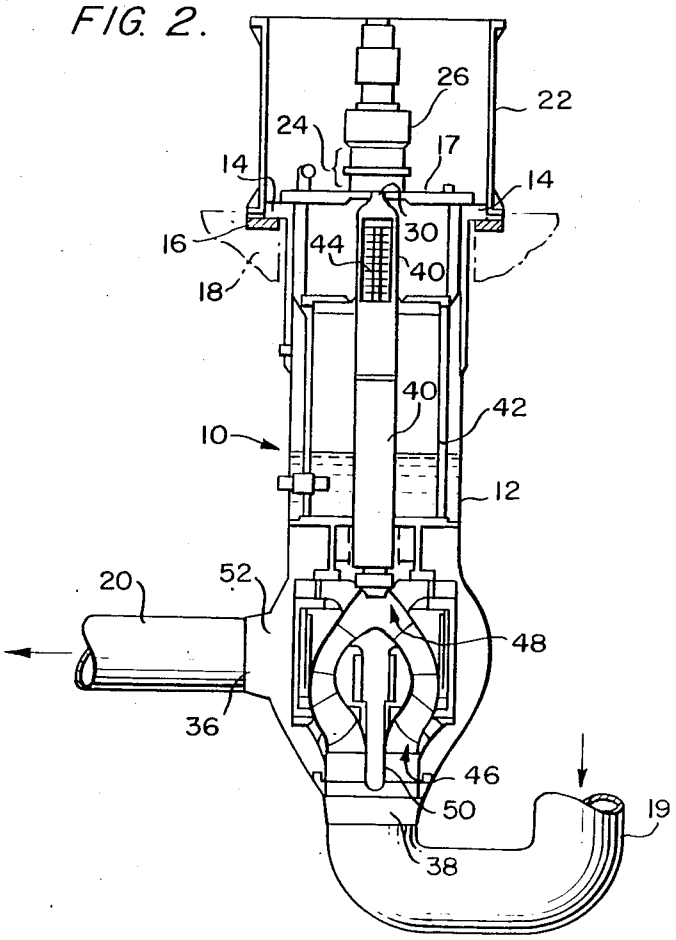
FIG. 2 is a side, fully sectioned view of the pump, as shown in FIG. 1, illustrating the booster stage, the high speed stage, and the coupling necessary for driving the high speed stage.

Referring now to FIGS. 1 and 2, the low NPSH pump 10 includes a second, or main stage, impeller 48 that is rotatively driven by a pump motor 34. The pump motor 34 includes an output rotor 32. The pump motor 34 is supported by a cylindrical housing 22, whose bottom-most end rests upon the mounting ring 16. The output rotor 32 includes a flange **32*a*, coupled to a flange 28*b* of a coupling 28, which serves to impart rotational drive to a drive shaft 30 and, in particular, is coupled to a flange 30*b* of the drive shaft 30. The drive shaft 30 is mounted within a bearing 26. A seal 24 is disposed about the drive shaft 30 and serves to prevent the escape of a blanket gas retained with the tank 12 and covering the liquid metal in the reservoir within the tank 12**.

Figure 3:
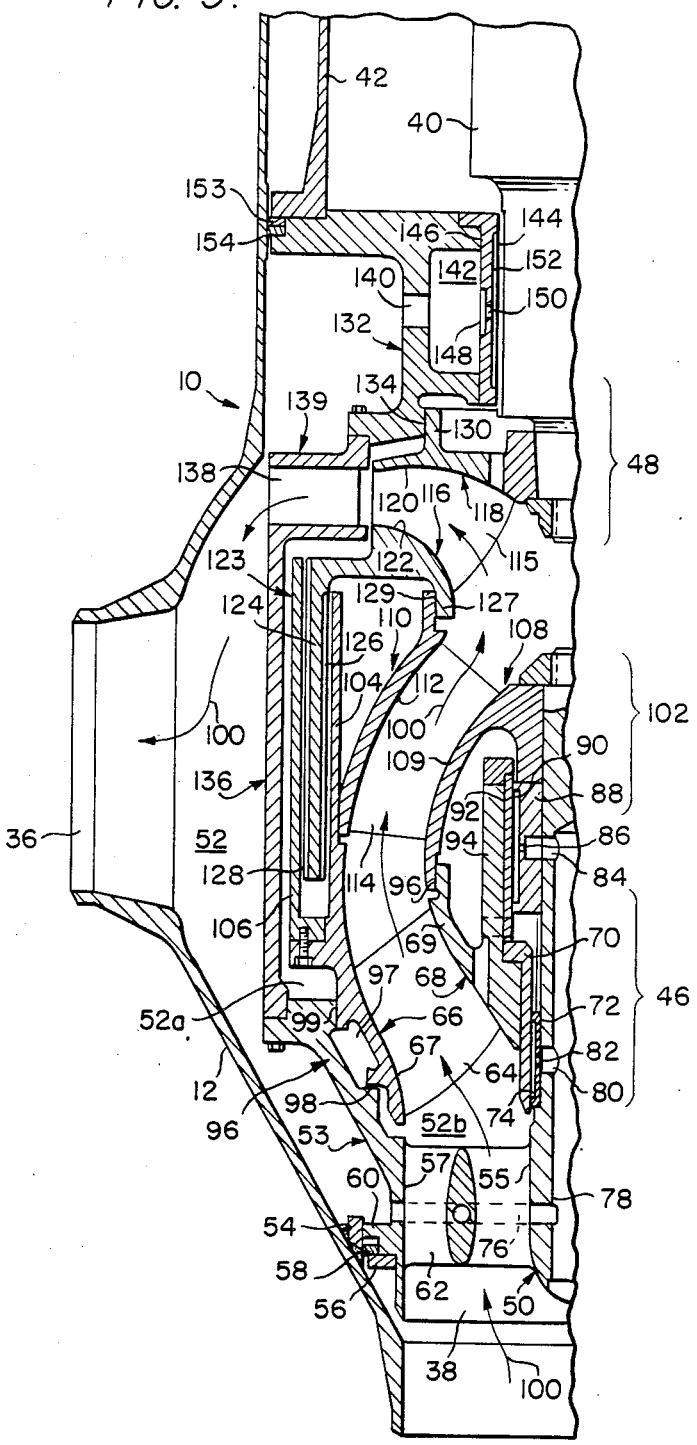
FIG. 3 is a side, partially sectioned view of the pump of FIGS. 1 and 2 particularly illustrating the details of the booster and high speed stages.

Referring now to FIGS. 2 and 3, the low NPSH pump 10 is vertically oriented with an inlet or suction nozzle 38 disposed at the bottom of the pump 10 to introduce a flow of the liquid from the inlet conduit 19 to be directed upward along a path identified by the arrows marked with the numerals 100, as shown in FIG. 3. The principle components of the low NPSH pump 10 are a first or booster stage impeller 46 for initially imparting kinetic and static pressure to the pump fluid, a diffuser 102 comprised of a set of diffuser vanes 114 for converting the fluid's kinetic energy to static energy, and a second or main stage impeller 48 rotatively driven by the pump motor 34. The main stage impeller 48 increases the static pressure of the fluid as it is driven into an annular space 52 to be discharged through an outlet or discharge nozzle 36 at a relatively high static pressure.

As shown in FIG. 2, the rotatively driven solid drive shaft 30 is integrally connected to a hollow pump rotor 40, which is in turn directly coupled to rotatively drive the main stage impeller 48. The heat transfer baffles 44, contained within the upper end of the hollow pump rotor 40, prevent the heat generated by the hot liquid metal and conducted to the internal void of the hollow shaft 40 from being radiatively transferred upward to the solid drive shaft 30 and thence conductively to the seal 24. A main cylinder support 42 is suspended from the cylinder flange 17 to support a bearing support housing 132 and an upper housing 136, as shown in FIG. 3 and to be described in detail below.

Referring now to FIG. 3, the liquid to be pumped is introduced into the inlet 38 and directed along the fluid path 100 upwardly. The booster stage impeller 46 is rotatively suspended upon a center post 50. The center post 50 is oriented along the axis of the tank 12 by a plurality, e.g., six, of struts 62. The outer ends of the struts 62 are connected to a support housing 53. The support housing 53 includes a flange 60 at its lower end and a pair of piston rings 58 clamped to flange 60 by a clamp ring 56. The outer diameter of rings 58 mate through sliding fit with the inner diameter of seal ring 54, which is secured as by welding to the inner peripheral surface of the tank 12. A generally cylindrically shaped upper housing 136 is coupled at its upper-most end to the bearing support housing 132 and at its bottom-most end to the support housing 53. The annular space 52 is formed between the inner surface of the tank 12 and the outer surfaces of the upper housing 136 and of the support housing 53. As illustrated in FIG. 3, the fluid flow path 100 is directed into the annular space 52 at a relatively high pressure. At the inlet or suction nozzle 38, the fluid path 100 is directed through an annular space formed by the outer surface 55 of the post 50 and the inner surface 57 of the support housing 53. The fluid path 100 is directed about the struts 62, which have an air foil shape, as illustrated in FIG. 3, to minimize any frictional losses of the fluid passing over the struts 62.

As shown in detail in FIG. 3, the booster stage impeller 46 includes a plurality of booster vanes 64, e.g., approximately six such vanes. The vanes 64 are of helical configuration and are formed between a conically shaped hub shroud 68 and an outer, booster stage shroud 66. The flow path 100 is directed upward between an outer peripheral surface 69 of the hub shroud 68 and an inner surface 67 of the outer shroud 66. Illustratively, the booster stage impeller 46, as comprised of the shrouds 66 and 68 and the vanes 64, may be illustratively molded as a single piece. The booster stage impeller 46 is rotatively mounted upon the center post 50 by a cylindrically shaped hub journal 70. A hub bearing sleeve 72 is mounted fixedly upon the surface 55 of the center post 50 for rotatively receiving the hub journal 70 and for forming a hydrostatic pocket 74 to be filled with the liquid pumped at a relatively high pressure to form a hydrostatic radial bearing to rotatively support the booster stage impeller 46. A second hydrostatic radial bearing is illustrated in FIG. 3 as being disposed above that bearing previously described and as including an upper bearing journal 92 affixed to a support member 94, which is of substantially cylindrical configuration and extends upwardly from the hub shroud 68. An upper bearing sleeve 88 is fixedly disposed upon the center post 50 to form with the journal 92 an upper hydrostatic pocket 90 for receiving the fluid under pressure.

The pressurized fluid is tapped from the annular space 52 and is introduced, as will be explained, into each of the lower hydrostatic pocket 74 and the upper hydrostatic pocket 90. In particular, a strut conduit 76 is disposed along the center of each of the struts 62 communicating at an outer end with the annular space 52 and at its inner end with an axial conduit 78 running along the axis or center line of the center post 50. In turn, the axial conduit 78 communicates with the lower hydrostatic pocket 74 through a series of radially disposed post orifice 80 and sleeve orifice 82 to introduce the liquid under pressure into the lower hydrostatic pocket 74. In similar fashion, the axial conduit 78 communicates via a series of post orifice 84 and sleeve orifice 86 with the upper hydrostatic pocket 90 introducing fluid under pressure therein.

The axial load of the booster stage impeller 46 is carried by a hydraulic balancing drum device 96, as shown in FIG. 3. The balancing device 96 essentially comprises an annularly shaped pressure pocket 97 formed between the outer, booster stage shroud 66 and the support housing 53. Pressurized fluid is introduced into the pressure pocket 97 from the pressurized fluid in an annular space **52*a* via an axial clearance 99. Pressurized fluid leaves the pressure pocket 97 through an inner running, radial clearance 98, entering a relatively low pressure space 52*b* at the booster stage impeller inlet. The pressure in the pocket 97 is self-compensating. As the pressure decreases within the pocket 97, the size of the inner, axial clearance 98 decreases thereby tending to increase the pressure within the pocket 97. Conversely, as pressure within the pocket 97 increases, the size of the inner, axial clearance 98 increases, thereby tending to permit the escape of the pressure fluid within the pocket 97. As a result, the booster stage impeller 46 is balanced on the pressurized fluid within the pocket 97 without any mechanical contact at the inner, axial clearance 98**.

The fluid path 100 continues upward within the low NPSH pump 10 from the booster stage impeller 46 into the diffuser 102. As shown in FIG. 3, the diffuser 102 includes a plurality of diffuser vanes 114 of helical configuration and mounted between a conically shaped, inner diffuser hub shroud 108 and an outer diffuser hub shroud 110. The fluid is directed along fluid path 100 as defined between a surface 109 of the inner diffuser hub shroud 108 and a surface 112 of the outer diffuser hub shroud 110. Illustratively, the shrouds 108 and 110, and the diffuser vanes 114 may be integrally molded as a single piece. The diffuser 102 is affixed to the center post 50 in a stationary position. The booster stage impeller 46 is rotatively driven by a coupling drum 124, as will be explained later, to impart kinetic and static head to the pumped fluid by the centrifugal action of the rotating booster stage impeller 46. As the fluid is directed along the fluid path 100 through the diffuser 102, most of the kinetic energy imparted to the fluid by the booster stage impeller 46 is converted to static energy within the stationary passages formed between the diffuser vanes 114 of the diffuser 102 to raise the static pressure as it approaches the main stage impeller 48. The booster stage impeller 46 is rotated at a relatively slow speed compatible with the low NPSH available at the suction nozzle 38 and with the low NPSH requirements of the main stage impeller 48. One of the critical requirements of the low NPSH pump 10 is to ensure a sufficiently high NPSH at the entrance to the main pump impeller 48 to avoid cavitation, i.e., the suction pressure as required by the main stage impeller 48 exceeds the vapor pressure of the fluid being pumped. The static pressure of the fluid exiting the booster stage impeller 46 is limited by the low NPSH requirements at the suction nozzle 38. Thus, the diffuser 102 is required to convert the kinetic energy of the fluid to static energy, thus, raising the static pressure of the fluid introduced to the main stage impeller 48 to a sufficiently high level to avoid cavitation.

The main stage impeller 48 is affixed to the pump rotor 40, whereby the main stage impeller 48 is rotatively driven by the pump motor 34. The main stage impeller 48 includes a plurality of main stage vanes 115, e.g., approximately 6 vanes, as formed between a main stage hub shroud 118 and an outer main stage shroud 116. The fluid is directed along the fluid path 100 through a passage formed by the main stage vanes 115 and an inner peripheral surface 120 of the main stage hub shroud 118, and a surface 122 on the outer main stage shroud 116. A cylindrically shaped, upright member 130 is integrally attached to the main stage hub shroud 118 to form a close clearance 134 with the bearing support housing 132. A cylindrically shaped, lip member 127 extends downward from the outer main stage shroud 116 to form a close clearance 129 with respect to the outer shroud 110 of the diffuser 102. The dimension of the close clearance 129 is set to permit free rotation of the main stage impeller 48 with respect to the stationarily disposed diffuser 102, while restricting the flow of liquid therethrough.

The pump rotor 40 is rotatively mounted within the bearing support housing 132. As illustrated in FIG. 3, the bearing support housing 132 is supported by an annularly shaped flange 154 suspended from the lower flange of the main support cylinder 42. A seal ring 153 is affixed to the outer diameter of flange 154. The outer diameter of this seal ring 153 mates with the inner diameter of the tank 12 through a close clearance sliding fit. This close clearance fit restricts high pressure liquid metal in the annular space around bearing support housing 132 from entering the reservoir of low pressure liquid metal existing in tank 12 above the bearing support flange 154. A cylindrically shaped bearing journal 144 is disposed about the lower end of the pump rotor 40 and forms, with a bearing sleeve 146, a hydrostatic pocket 152 therebetween. The cylindrically shaped bearing sleeve 146 is supported by the bearing support housing 132. Radial holes 140 are disposed within the bearing support housing 132 and a series of bearing orifices 148 and 150 permit the introduction of fluid at a relatively high pressure from the annular space 52 into the hydrostatic pocket 152 to facilitate the rotation of the pump rotor 40.

As shown in FIG. 3, the cylindrically shaped upper housing 136 is suspended within the tank 12 from the bearing support housing 132. An upper diffuser 139 is formed with an upper portion of the upper housing 136 and comprises a plurality of diffuser vanes 138, e.g., 12 such vanes 138. The upper diffuser 139 converts the kinetic energy imparted to the fluid by the main stage impeller 48 rotating at a relatively high speed into static energy, whereby the total pressure of the fluid introduced into the annular space 52 is increased.

A speed reduction coupling 123 is inserted between the main stage impeller 48 rotating at a relatively high speed, and the booster stage impeller 46 rotating at a relatively high speed, the speed reduction being attributable to the coupling 123. As shown in FIG. 3, the speed reduction coupling 123 comprises a cylindrically shaped coupling drum 124 suspended vertically and downwardly from the outer main stage shroud 116. An inner drag coupling member 104 and an outer drag coupling member 106 are affixed to the booster stage impeller 46 to extend vertically upward for receiving therebetween the coupling drum 124. As seen in FIG. 3, access to the speed reduction coupling 123 is provided in a space between the output of the diffuser 102 and the upper diffuser 139 to permit the flow of relatively high pressure fluid to the speed reduction coupling 123. A first plurality of friction grooves 126 is disposed about the inner peripheral surface of the coupling drum, and a second plurality of friction grooves 128 is disposed about the outer peripheral surface of the coupling drum 124, whereby the surface drag coefficient between the pressurized fluid and the coupling drum 124 is increased.

Figure 4:
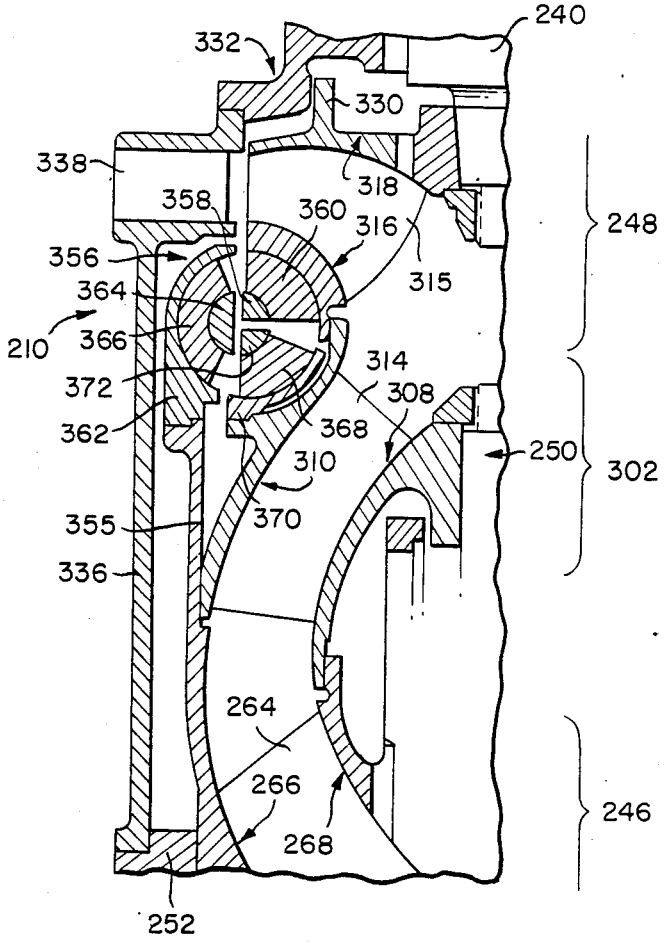
FIG. 4 is a partially sectioned, side view of a further embodiment of this invention and, in particular, the mechanism for coupling the high speed stage to the booster stage to impart rotational movement to the booster stage.

Referring now to FIG. 4, there is shown a further embodiment of a low NPSH pump 210, wherein like elements are identified with corresponding numerals to the elements of the low NPSH pump 10 shown in FIG. 3, but renumbered in the two and three hundred series. The low NPSH pump 210 employs a torque converter 356 in place of the speed reduction coupling 123, as shown in FIG. 3. The torque converter 356 is made up of three sets of vanes, namely a set of impeller vanes 360, a set of turbine vanes 366, and a set of stationary vanes 368. The set of impeller vanes 360 is integrally affixed to the main stage impeller 248 and, in particular, to the main stage outer shroud 316. The impeller vanes 360 are of a helical configuration and extend to an impeller shroud 358. As explained above, the main stage impeller 248 is driven by the pump motor to drive the pumped liquid in a corresponding direction, i.e., if the main stage impeller 248 is rotated in a clockwise direction as looking from the top of the low NPSH pump 210, the pumped liquid will be likewise directed in a clockwise direction to strike and rotate the turbine blades 366, which are mounted between a turbine shroud 362 and a turbine inner shroud 364.

As illustrated in FIG. 4, the turbine shroud 362 is affixedly mounted to an upright support member 355 which is integral with the outer, booster stage shroud 266 of the booster stage impeller 246, whereby the booster vanes 264 are rotatively driven. The fluid leaving the turbine vanes 366 is directed in an opposite direction to that entering the turbine vanes 366, i.e., if the entering liquid is directed in a clockwise direction, the discharged liquid will be directed in a counterclockwise direction. The liquid leaving the turbine vanes 366 is received and redirected by the stationary vanes 368, which are mounted between a stationary converter shroud 370 and a stationary converter shroud 370. As shown in FIG. 4, the stationary converter shroud 372 is affixed to the outer shroud 310 of the diffuser 302, whereby the stationary vanes 368 are held stationary with respect to the rotating vanes 360 and 366. As a result, the liquid as directed in a counterclockwise direction onto the vanes 368 is redirected by the helically shaped vanes 368 to be directed onto the impeller vanes 360 along a vector disposed substantially parallel with respect to the axis of the pump 210.

In comparing the torque converter 356, as shown in FIG. 4, to the speed reduction coupling 123, as shown in FIG. 3, the coupling 123 is a constant torque device, whereas the converter 356 is a constant power device. In other words, coupling 123 operates such that the input torque in terms of pounds force times radius arm as exerted upon the main stage impeller 48 equals the torque transmitted to the booster stage impeller 46. The efficiency of the coupling 123 as compared with that of the torque converter 356, calculated as follows, is relatively low:

$$\text{eff.} = \frac{\text{output speed}}{\text{input speed}} = \frac{350}{800} = .438$$

where the main stage impeller 48 is rotated at 800 rpm and the booster stage impeller 46 is rotated at 350 rpm. The brake horsepower (BHP) required by the booster stage impeller 46 assuming that the impeller vanes 115 are 80% efficient is calculated as follows:

$$BHP = \frac{QH}{3960 \times \text{eff.}} = \frac{85000 \times 50}{3960 \times .80} = 1341.5$$

indicating a requirement of 1341.5 HP output from the hydraulic coupling. In turn, the horsepower (HP) input to the viscous drag coupling 123 from the main impeller 48 is calculated as follows:

$$\text{input HP} = \frac{\text{coupling output HP}}{\text{coupling eff.}} = \frac{1341.5}{.438} = 3063$$

Since a relatively high slip, i.e., low efficiency, is necessary to transmit the high torque to the booster stage impeller 46, the viscous drag coupling 123 provides a limited output speed to the booster stage impeller 46.

By contrast, the torque converter 356 has a relatively higher efficiency output and is capable of rotating its booster stage impeller 246 at a greater rotational velocity. Efficiencies of up to 90% have been reported for torque converters similar to the converter 356 as shown in FIG. 4.

The horsepower (HP) input to the torque converter coupling 356 is calculated as follows:

$$\text{input HP} = \frac{\text{coupling output HP}}{\text{coupling eff.}} = \frac{1341.5}{.09} = 1491$$

The overall efficiency for the total pump, i.e., booster stage impeller plus the main stage impeller, is calculated as follows:

$$\text{o'all eff.} = \frac{\text{total pump head}}{\dfrac{\text{booster stg. hd.}}{\text{booster stg. eff.} \times \text{hyd. drive eff.}} + \dfrac{\text{main pump hd.}}{\text{main pump stg. eff.}}}$$

Thus, for a main pump with 450 feet head and 85% efficiency, the overall efficiency of the low NPSH pump 10, as equipped with a viscous drag coupling 123, is calculated as 0.744. By contrast for the low NPSH pump 210 with the torque converter 356, the overall efficiency is calculated as 0.835. Thus, it is seen that the torque converter 356 does achieve a significantly higher overall pump efficiency, but costs more to construct than the viscous drag coupling 123.

Therefore, this invention provides an effective means for pumping volatile liquids.

I claim as my invention:

1. Apparatus for pumping a volatile fluid having a given vapor pressure, said pumping apparatus comprising:

(a) a pump housing defining an axis and comprising an inlet for introducing the fluid at a relatively low static pressure level in to said pump housing, an outlet for discharging the fluid from said pump housing at a relatively high static pressure level, and means for defining a fluid path between said inlet and said outlet;

(b) a center post supported within said pump housing about said axis by a plurality of struts, each strut affixed at its inner end to said center post and at its outer end to said pump housing;

(c) a booster state impeller rotatively mounted about said axis within said pump housing adjacent said inlet for drawing the fluid through said inlet and for pumping the fluid along said fluid path with an increased kinetic pressure;

(d) a diffuser affixedly attached to said center post and comprising a plurality of stationary passages disposed to intercept the fluid directed along said fluid path by said booster stage impeller and to direct the fluid substantially along said axis, thus converting the kinetic pressure imparted to the fluid by said booster stage impeller into increased static pressure;

(e) a pump motor;

(f) a main stage impeller rotatively mounted about said axis within said pump housing and coupled to said pump motor to be rotated at a relatively high speed to impart a relatively high static pressure to the fluid being introduced thereto from said diffuser and for discharging the fluid at a relatively high static pressure; and (g) hydraulic coupling means disposed remotely from said fluid path for hydraulically coupling said main stage impeller and said booster stage impeller to rotate said booster stage impeller at a relatively low speed selected to maintain the lowest positive suction pressure applied to the fluid at said inlet greater than said vapor pressure, said hydraulic coupling means comprising a cylindrically shaped drum affixed to said main impeller for rotation about an axis therewith, and a pair of cylindrical members affixed to said booster stage impeller for rotation about said axis, said pair of cylindrical members being spaced from each other for receiving said drum member therebetween, said stationary passages being formed to ensure that the low net positive suction head as established by said main impeller upon the fluid introduced thereto exceeds said vapor pressure.

2. The pumping apparatus as claimed in claim 1, said booster stage impeller being rotatively mounted about said center post.

3. Apparatus for pumping a volatile fluid having a given vapor pressure, said pumping apparatus comprising:

(a) a pump housing defining an axis and comprising an inlet for introducing the fluid at a relatively low static pressure level into said pump housing, an outlet for discharging the fluid from said pump housing at a relatively high static pressure level, and means for defining a fluid path between said inlet and said outlet;

(b) a center post supported within said pump housing about said axis by a plurality of struts, each strut affixed at its inner end to said center post and at its outer end to said pump housing;

(c) a booster stage impeller rotatively mounted about said center post within said pump housing adjacent said inlet for drawing the fluid through said inlet and for pumping the fluid along said fluid path with an increased kinetic pressure;

(d) at least one bearing for mounting said booster stage impeller upon said center post, said bearing comprising a bearing sleeve and a bearing journal for defining therebetween a hydrostatic cavity for receiving the fluid, wherein at least one of said plurality of struts and said center post comprise means for defining a passage in communication between said high pressure cavity and said hydrostatic cavity for introducing fluid at a relatively high pressure into said hydrostatic cavity;

(e) a diffuser affixedly attached to said center post and comprising a plurality of stationary passages disposed to intercept the fluid directed along said fluid path by said booster stage impeller and to direct the fluid substantially along said axis, thus converting the kinetic pressure imparted to the fluid by said booster stage impeller into increased static pressure;

(f) a pump motor;

(g) a main stage impeller rotatively mounted about said axis within said pump housing and coupled to said pump motor to be rotated at a relatively high speed to impart a relatively high static pressure to the fluid being introduced thereto from said diffuser and for discharging the fluid at a relatively high static pressure; and (h) hydraulic coupling means disposed remotely from said fluid path for hydraulically coupling said main stage impeller and said booster stage impeller to rotate said booster stage impeller at a relatively low speed selected to maintain the low net positive suction pressure applied to the fluid at said inlet greater than said vapor pressure, said hydraulic coupling means comprising a cylindrically shaped drum affixed to said main impeller for rotation about an axis therewith, and a pair of cylindrical members affixed to said booster stage impeller for rotation about said axis, said pair of cylindrical members being spaced from each other for receiving said drum member therebetween, said stationary passages being formed to ensure that the low net positive suction head as established by said main stage impeller upon the fluid introduced thereto exceeds said vapor pressure.

4. Apparatus for pumping a fluid, said pumping apparatus comprising:

(a) a pump housing comprising an inlet for introducing the fluid into said pump housing, an outlet for discharging the fluid from said pump housing, means for defining a fluid path between said inlet and said outlet, a support post, and means for affixedly supporting said post within said housing;

(b) booster stage impeller rotatively mounted about said support post adjacent said inlet for drawing the fluid through said inlet for pumping the fluid along said fluid path;

(c) a diffuser affixedly mounted to said support post within said pump housing to intercept the fluid directed along said fluid path by said booster stage impeller and to convert the kinetic pressure imparted to the fluid by said booster stage impeller into increased static pressure;

(d) a pump motor;

(e) a main stage impeller rotatively mounted within said pump housing and coupled to said pump motor to be rotated at a relatively high speed in increase the fluid pressure and for discharging the fluid at a relatively high static pressure at said outlet;

(f) said pump housing further comprising means for defining a hydraulic chamber having a communication with said fluid path limited to hydraulically isolate the fluid within said hydraulic chamber form said fluid path; and (g) hydraulic coupling means disposed within said hydraulic chamber for hydraulically coupling said main stage impeller and said booster stage impeller to rotate said booster stage impeller at a lower speed that that of said main stage impeller.

5. The pumping apparatus as claimed in claim 4, wherein there is included bearing means mounted on said support post for rotatively mounting said booster stage impeller, and said housing includes means in communication with said outlet for directing the fluid of said increased static pressure through said support post to said bearing means, whereby the fluid of said increased static pressure serves to lubricate said bearing means.

6. The pumping apparatus as claimed in claim 4, wherein there is included at least one strut having one end affixed to said housing and another end affixed to said support post for supporting said support post within said housing.

7. The pumping apparatus as claimed in claim 5, wherein there is included at least one strut having a first end affixed to said housing and a second end affixed to said support post for supporting said support post within said housing, said support post having a centrally disposed first passage therein, and said directing means includes a second passage through said strut in communication with said first passage.

8. The pumping apparatus as claimed in claim 5, wherein there is included a second bearing means disposed along said support post and spaced from said first-mentioned bearing means to substantially prevent the axis of rotation of said booster stage impeller from moving with respect to said pump housing.

* * * * *